US008002044B2

(12) United States Patent
Fay et al.

(10) Patent No.: US 8,002,044 B2
(45) Date of Patent: Aug. 23, 2011

(54) COUPLER RETAINED LINER HANGER MECHANISM WITH MOVEABLE COVER AND METHODS OF SETTING A HANGER INSIDE A WELLBORE

(75) Inventors: Peter J. Fay, Houston, TX (US); Gerald D. Lynde, Houston, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 266 days.

(21) Appl. No.: 12/455,536

(22) Filed: Jun. 3, 2009

(65) Prior Publication Data

US 2010/0307767 A1 Dec. 9, 2010

(51) Int. Cl.
*E21B 43/10* (2006.01)

(52) U.S. Cl. ..... 166/382; 166/208

(58) Field of Classification Search ..... 166/137, 166/136, 123, 179, 181, 382, 208, 211, 215
See application file for complete search history.

(56) References Cited

U.S. PATENT DOCUMENTS

| | | | | |
|---|---|---|---|---|
| 1,757,363 | A | 5/1930 | Fischbach | |
| 2,053,065 | A | 9/1936 | Crowell | |
| 2,118,497 | A * | 5/1938 | Crickmer | 166/211 |
| 2,427,330 | A | 9/1947 | Spencer | |
| 2,754,134 | A | 7/1956 | Watts et al. | |
| 2,764,243 | A * | 9/1956 | Page | 166/119 |
| 2,880,806 | A | 4/1959 | Davis | |
| 3,195,646 | A | 7/1965 | Brown | |
| 3,227,218 | A * | 1/1966 | Fisher, Jr. et al. | 166/216 |
| 3,491,831 | A | 1/1970 | Dollison | |
| 3,920,075 | A | 11/1975 | Braddick et al. | |
| 4,295,523 | A | 10/1981 | Mott | |
| 4,307,781 | A | 12/1981 | Preston, Jr. et al. | |
| 4,310,048 | A | 1/1982 | Mott | |
| 4,497,368 | A | 2/1985 | Baugh | |
| 4,697,640 | A * | 10/1987 | Szarka | 166/120 |
| 4,712,614 | A | 12/1987 | Allwin et al. | |
| 4,712,615 | A * | 12/1987 | Dockins et al. | 166/208 |
| 5,226,484 | A | 7/1993 | Stephen | |
| 5,255,746 | A | 10/1993 | Bridges | |
| 5,311,941 | A | 5/1994 | Baugh | |
| 5,325,926 | A | 7/1994 | Lay et al. | |
| 5,327,964 | A | 7/1994 | O'Donnell et al. | |

(Continued)

FOREIGN PATENT DOCUMENTS

CN 1064562 9/1992

*Primary Examiner* — David Bagnell
*Assistant Examiner* — Jacob Hall
(74) *Attorney, Agent, or Firm* — Greenberg Traurig LLP; Anthony F. Matheny

(57) ABSTRACT

A liner hanger has a housing with a pocket disposed on an inner wall surface and a slip slidingly engaged within the pocket. A moveable cover is disposed interior to the slip thereby restricting movement of the slip from a unset position to a set position. The liner hanger housing is secured in the string of casing and an actuator is mounted on the liner. As the liner is moved through the casing coupler, the actuator actuates the cover, causing the cover to be moved so that the slip can move axially downward from its unset position to its set position. As the cover is moved, the slip moves radially inward and grips the liner to secure the liner within the casing string of the wellbore.

13 Claims, 12 Drawing Sheets

U.S. PATENT DOCUMENTS

| | | | | |
|---|---|---|---|---|
| 5,579,829 | A | 12/1996 | Comeau et al. | |
| 5,586,601 | A | 12/1996 | Pringle | |
| 6,138,751 | A | 10/2000 | Hart | |
| 6,568,471 | B1 | 5/2003 | Cook et al. | |
| 6,631,759 | B2 | 10/2003 | Cook et al. | |
| 6,691,788 | B1 * | 2/2004 | Dearing | 166/382 |
| 6,705,395 | B2 | 3/2004 | Cook et al. | |
| 6,857,473 | B2 | 2/2005 | Cook et al. | |
| 7,114,573 | B2 * | 10/2006 | Hirth et al. | 166/382 |
| 7,284,617 | B2 | 10/2007 | Pietras | |
| 7,537,060 | B2 | 5/2009 | Fay et al. | |
| 7,540,329 | B2 | 6/2009 | Fay et al. | |
| 7,581,595 | B2 | 9/2009 | Fay et al. | |
| 7,604,061 | B2 | 10/2009 | Fay et al. | |
| 2002/0100595 | A1 | 8/2002 | Cook et al. | |
| 2003/0066655 | A1 | 4/2003 | Cook et al. | |
| 2003/0183396 | A1 | 10/2003 | Adams et al. | |
| 2004/0221997 | A1 | 11/2004 | Giroux et al. | |
| 2006/0185855 | A1 | 8/2006 | Jordan et al. | |
| 2006/0249285 | A1 | 11/2006 | Birckhead et al. | |
| 2008/0110643 | A1 | 5/2008 | Richard et al. | |
| 2008/0230233 | A1 | 9/2008 | Fay et al. | |
| 2008/0257561 | A1 | 10/2008 | Fay et al. | |
| 2009/0159268 | A1 | 6/2009 | Fay et al. | |
| 2009/0159296 | A1 | 6/2009 | Fay et al. | |

* cited by examiner

COUPLER RETAINED LINER HANGER MECHANISM WITH MOVEABLE COVER AND METHODS OF SETTING A HANGER INSIDE A WELLBORE

BACKGROUND

1. Field of Invention

The invention is directed to couplers or collars having one or more axially movable slips disposed therein for connecting oil and gas well casing and for hanging a liner within the casing and, in particular, to couplers having the slip initially disposed behind a moveable cover that is moved to permit setting of the slip.

2. Description of Art

A liner is a tubular member that is usually run inside of wellbore casing of an oil or gas well and suspended within the wellbore casing. Liners are typically secured within a wellbore by toothed slips that are located on liner hangers. The slips are set by axially translating them with respect to the liner hanger mandrel or housing. As the slips are translated axially, they are cammed radially outward by a ramped surface that is fashioned into the mandrel. As the slips move radially outward, the toothed surfaces of the slip will bitingly engage the inner wall surface of the wellbore casing. This type of arrangement is shown, for example, in U.S. Pat. No. 4,497,368 in which slips are radially expanded by riding up over cone elements disposed into the tubular body of the central mandrel.

Actuation systems for such slips in the past employed full circumference hydraulically actuated pistons to move the slips. These designs presented a pressure rating problem in that the full circumference piston frequently had a maximum working pressure significantly lower than the mandrel which it surrounded. Thus, this type of design limited the maximum working pressure in the string to the rating of the cylindrical piston housing assembly. For example, it was not unusual in prior designs to have mandrels rated for 12,000 PSI while the surrounding cylinder housing for the cylindrical piston to only have a rating of approximately 3,000 PSI.

In an effort to improve the shortcoming of this design, another design illustrated in U.S. Pat. No. 5,417,288 was developed. In this design the mandrel body received a pair of bores straddling each of the slips. A piston assembly was mounted in each of the bores with all of the necessary seals. The application of hydraulic pressure in the mandrel into all the piston bores actuated the pistons on either side of each slip through a common sleeve to which all the slips were attached. This design, however, was expensive to manufacture, had many potential leak paths in the form of the ring seals on each of the pistons wherein each slip required two pistons.

On the other hand, this design provided for a higher pressure rating for the liner hanger body and also used the hydraulic pressure directly to actuate the slips. Necessarily, it did not include a locking feature against premature slip movements due to inadvertently applied pressures. The design in U.S. Pat. No. 5,417,288 also did not provide for flexibility for changed conditions downhole which could require additional force to set the slips. In essence, each application was designed for a pre-existing set of conditions with field variability not included as a feature of that prior art design.

These prior liner hangers also required use of devices and structures that increase the overall outer diameter of the liner hanger. Therefore, these liner hangers result in a reduction of usable diameter within the well. This is because the liner hanger is carried by the liner which requires the liner to be of a smaller diameter than the casing against which it is set or hung. The liner is then set within the annular space between the liner and the casing. Once set, the useable diameter of the well (i.e., the diameter through which production fluid can flow or tools can be passed) becomes the inner diameter of the liner. However, the components of the device securing the liner within the casing (including slips, elastomeric seals, setting sleeves and so forth) inherently occupy space between the liner and casing. For example, a wellbore having standard 21.40 lb. casing with an outer diameter of 5 inches, would have an inner diameter of 4.126 inches. It would be desirable to run into the casing a string of tubing, i.e., a liner, having an outer diameter of approximately 4 inches, which would allow for a liner with a large cross-section area for fluid flow and tool passage. However, the presence of the liner setting components on the outside of the liner will dictate that a smaller size liner or tubing string (such as 2⅞ inches) be run. Over an inch of diameter in usable area is lost due to the presence of both the liner and the liner setting device that is set within the space between the liner and the casing.

With respect to the slip assemblies, in the past those slip assemblies also have been configured in a variety of ways. In one configuration, when the slips are actuated, the load is passed through the slips circumferentially through their guides or retainers and transmission of the load to the underlying mandrel is avoided. In other more traditional designs, the slips are driven along tapered surfaces of a supporting cone and the loading that is placed on the supporting mandrel is in a radial direction toward its center, thus tending to deform the mandrel when setting the slips. Typical of such applications are U.S. Pat. Nos. 4,762,177, 4,711,326 and 5,086,845.

In another prior attempt, illustrated in U.S. Pat. No. 6,431,277, the liner hanger has an actuating piston that releases a mechanical latch that is restraining a set of springs. Once the latch is released, the springs set the slips. The liner hanger in this patent is also designed with a separate spring housing that restricts the total number of springs that can be used and is difficult to assemble.

SUMMARY OF INVENTION

Liner hanger devices disclosed herein are directed to a coupler or collar for joining two pieces of oil or gas well casing. The coupler includes an enlarged inner diameter portion forming a pocket in the inner wall surface of the coupler. Slidingly engaged within the pocket is a slip. The slip is disposed behind a moveable cover that prevents the slip from setting until it is moved.

In use, the coupler secures together two pieces of casing. The casing is then run into the wellbore to the desired depth. Although not required, the casing can then be cemented into place.

An inner tubing, or liner, such as production casing is then run into the casing. The liner includes an actuator that is operatively associated with the cover. As the liner is lowered within the casing, the actuator actuates the cover so that the cover is moved from a first position in which the cover restricts movement of the slip to a second position in which the slip is capable of movement to its lower or set position in which the liner is secured within the casing.

Because the slip and cover are located within the pocket portion of the casing coupler, the liner can be set or hung within the casing while saving useable cross-sectional area within the casing. In the instance of the 5 inch casing situation described above in the Background section, a liner having a four inch diameter could be run into the exterior casing.

Figure 1:
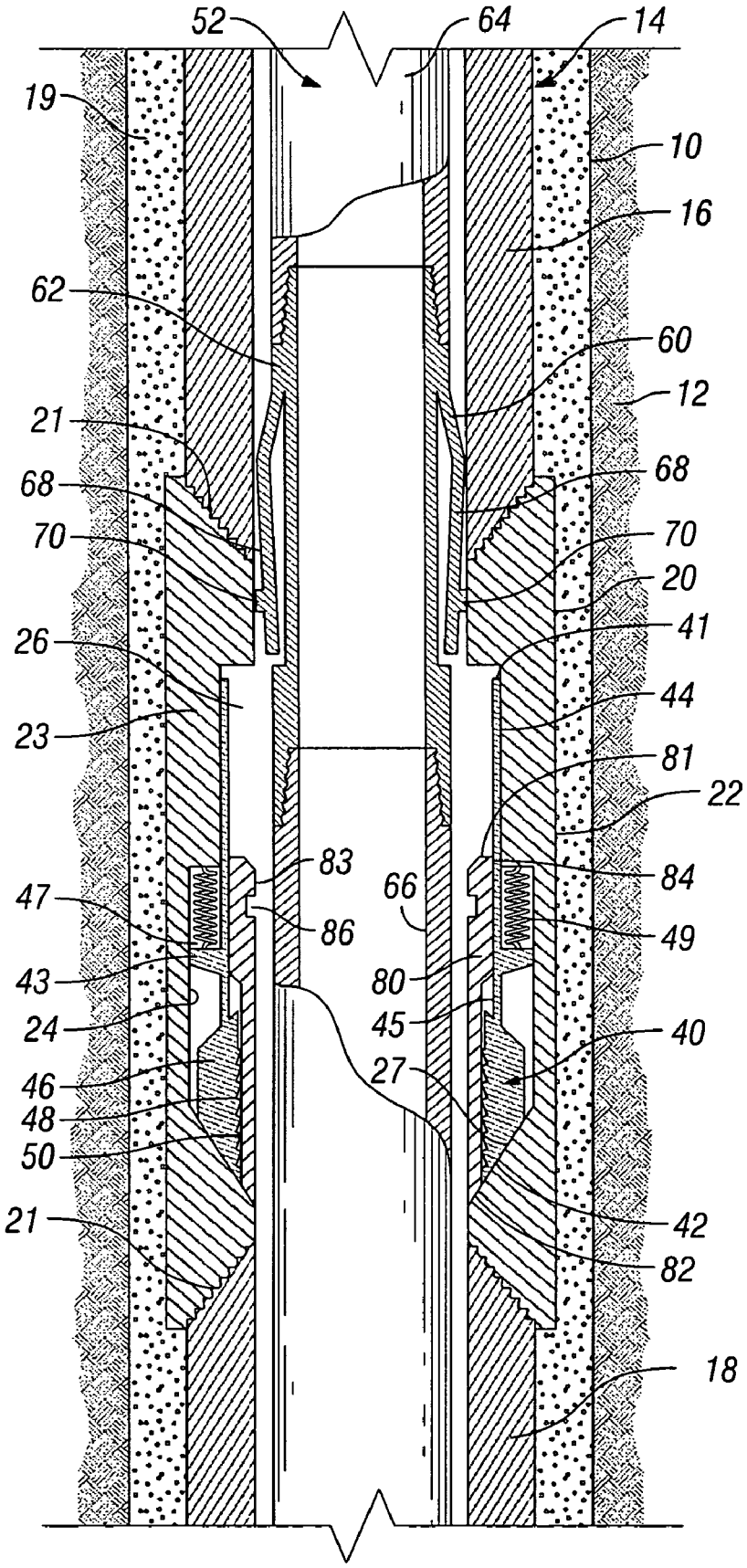
FIG. 1 is a partial cross sectional view of wellbore casing showing one specific embodiment of the coupler of the present invention during run-in of a liner.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-12, the invention is described broadly with respect to wellbore 10 disposed within formation 12 having casing string or casing 14 disposed therein. Casing string 14 includes upper casing section 16 and lower casing section 18. Upper casing section 16 is supported at its upper end, either directly or indirectly though another piece of casing, by a wellhead assembly. Collar or coupler 20 connects upper casing section 16 with lower casing section 18 using any method or device known to persons of ordinary skill in the art, such as by threads 21. Casing string 14 and coupler 20 can be secured within formation 12 by cement 19. As shown, upper casing section 16 and lower casing section 18 have the same inner and outer diameters.

Coupler 20 includes an outer wall surface 22 defining an outer diameter, housing 23, and inner wall surface 24 defining various inner diameters. Inner wall surface 24 includes recess or pocket 26 defined by a variable enlarged inner diameter between two smaller inner diameters—one above and one below. Shoulder 27 of pocket 26 is conical. As discussed below, the inner wall surface 24 of pocket 26 has differing shapes depending on the specific embodiment.

Slip 40 is disposed within pocket 26. Slip 40 includes first end 41 and second end 42. Slip second end 42 includes gripping member 46 having slip gripping profile 48 for engaging or biting into liner 52 being hung within wellbore 10. First end 41 is part of upper portion 44 which can be a single solid sleeve, a single partial sleeve, or a plurality of partial sleeves separated by vertical slots and disposed circumferentially around pocket 26.

Gripping member 46 is connected to the setting mechanism by connection member 45. The lower ends of gripping members 46 are tapered to mate with shoulder 27. Connection member 45 is a flexible or collapsible thin walled portion of slip 40 whose flexibility or collapsibility facilitates setting of slip 40. Connection member 45 may be a single thin walled sleeve, a single partial thin walled sleeve, or a plurality of thin walled strips or partial sleeves separated by vertical slots so that each gripping member 46 is connected to upper portion 44 of slip 40.

Gripping profile 48 may have wickers or any other configuration that facilitates gripping profile 48 to grip or bite into liner 52 being hung within casing 14. For example, gripping profile 48 may include teeth 50. Alternatively, gripping profile 48 may be profiled with grippers formed of carbide or other material, velcro material, ball bearings, or spray-on grit surfaces, or any other material that facilitates increased friction or provides surface penetration of the gripping profile 48 into liner 52. In one specific embodiment, gripping profile 48 is curved or concave, having the same curvature as the outer diameter of liner 52. In another specific embodiment, gripping profile 48 is a cam surface causing a camming motion against liner 52 to facilitate securing liner 52 to wellbore casing 14. In a particular embodiment, gripping profile 48 is angled such that upward movement of a structure, such as an outer wall surface of cover 80 along gripping profile 48, does not encourage or cause "biting" or "camming" of gripping profile 48 into the structure moving upward along gripping profile. To the contrary, downward movement or force by a structure, such as an outer wall surface of liner 52, encourages or causes "biting" or "camming" of gripping profile 48 into the structure.

Slip 40 is initially restricted from movement within pocket 26 by cover 80. Cover 80 comprises upper end 81, lower end 82, inner wall surface 83, and outer wall surface 84. As discussed in greater detail below, cover 80 has a first position in which slip 40 is restricted from movement to its set position and a second position in which slip 40 is capable of movement to its set position.

Figure 2:
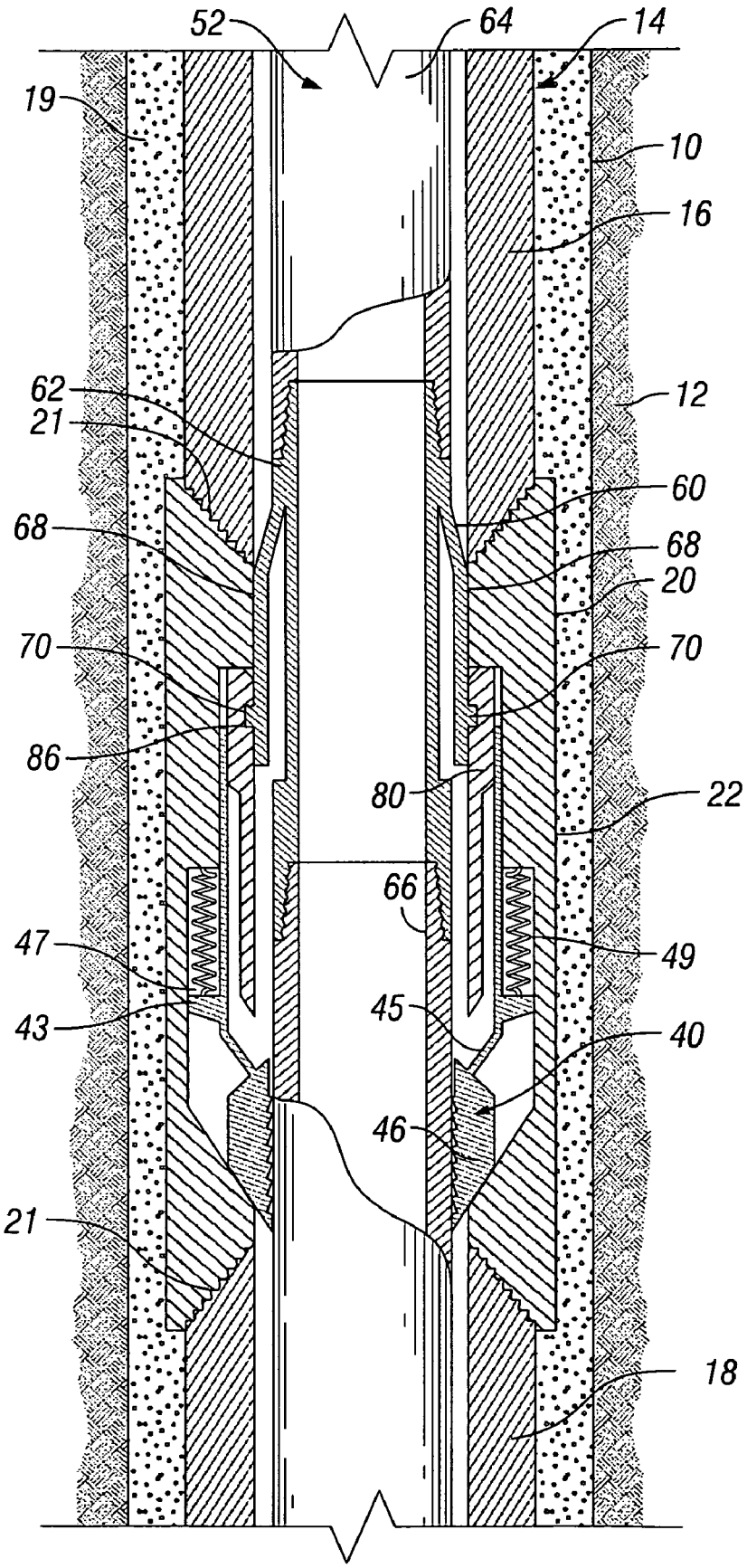
FIG. 2 is a partial cross-sectional view of the wellbore casing of FIG. 1 showing the coupler of FIG. 1 and the liner in the set position.

Referring now to FIGS. 1-2, in one specific embodiment, inner wall surface 83 of cover 80 comprises one or more recesses 86 disposed circumferentially around the inner diameter of cover 80. It is to be understood that the term recess 86 includes a single continuous groove uninterruptedly disposed around the inner diameter of cover 80 as well as one or more slots interruptedly disposed around the inner diameter of cover 80.

In the embodiment of FIGS. 1-2, slip 40 also comprises slip flange 43 disposed on the outer wall surface of slip 40. Slip flange 43 is in sliding engagement with the inner wall surface of pocket 26. Pocket 26 is shaped by inner wall surface 24 such that chamber 47 is formed by the outer wall surface of slip 40, the upper surface of slip flange 43, and two pocket wall surfaces. In the embodiment of FIG. 1-2, a downwardly biased member, shown as coiled spring 49 in FIGS. 1-2, is disposed within chamber 47. Although shown as coiled spring 49, it is to be understood that the downwardly biased member may be a set of belleville washers, or any other biased member known in the art. As discussed in greater detail below, the downwardly biased member facilitates movement of slip 40 from its upper, unset, position (FIG. 1) to its lower, set, position (FIG. 2) when cover 80 is moved from its first position (FIG. 1) to its second position (FIG. 2).

Recess 86 is engaged by an actuator, which in this embodiment is collet 60 disposed on sub 62, which is secured to two sections 64, 66 of liner 52. Alternatively, collet 60 may be secured directly to the outer diameter of a piece of liner such as through welding.

Collet 60 includes one or more outwardly biased fingers 68, each finger 68 having key or tab 70 for engagement within recess 86 of cover 80. Each finger 68 is forced inward by the inner wall surface of casing 14 and then by inner wall surface 83 of cover 80 during run-in of liner 52. When finger 68 is disposed opposite recess 86 by moving liner 52 downward within casing 14, the outwardly biased fingers 68 move outward so that keys 70 of fingers 68 are inserted into recess 86. After engagement of keys 70 into recess 54, cover 80 can be moved upward from its first position (shown in FIG. 1) to its second position (shown in FIG. 2) by upward movement of liner 52. Subsequently, slip 40 can move downward from its upper or unset position (FIG. 1) to its lower or set position (FIG. 2). In so doing, gripping member 46 is moved radially inward from pocket 26 and into the outer wall surface of liner 52. Gripping profile 48 engages, bites, or cams into the outer wall surface of liner 52, resulting in liner 52 being secured within casing 14 as shown in FIG. 2.

In one embodiment, shown in FIG. 2, connection member 45 flexes to facilitate gripping member 46 being moved radially inward. In an alternative embodiment, connection member 45 collapses into an "accordion" shape to facilitate gripping member 46 being moved radially inward. The weight of liner 52 maintains slips 40 in the set or lower position. It is noted, however, that upon lifting the liner upward, the weight acting downward on slip 40 is decreased such that liner 52 may be lifted. Alternatively, liner 52, once set, could be cemented in place. Liner 52 may be run in on a running string that is later retrieved from liner 52. A seal (not shown) may be installed between liner 52 and casing 14.

Initially, slip 40 is fully recessed within pocket 26. Because the components of cover 80 and slip 40 are retained within pocket 26 of casing coupler 20, the gap between the exterior of liner 52 and the interior of casing string 14 can be quite small. For example, in a casing string made up of 35.3 lb., casing sections with an external diameter of 5 inches, an interior diameter of 4.126 inches would be available. Thus, it would be possible to insert liner 52 having a diameter approximating 4 inches, rather than a smaller diameter liner such as one having a diameter of 2⅞ inches. As mentioned above, the use of a larger diameter liner 52 is desirable for two reasons. First, the resulting available cross-sectional flow and work bore area of liner 52 will be larger. Second, gripping member 46 of slip 40 can be more easily and securely held against the larger diameter liner 52.

Liner 52 is lowered within the housing bore of casing 14 and through the bore of coupler 20 until tabs 70 engage recess 86. Liner 52 is then lifted upward causing cover 80 to be moved upward until slips 40 are freed to move radially inward. In so doing, the stored energy within the downwardly biased member is released such that a downward force is exerted on slip flange 43 resulting in the downwardly biased member, (spring 49 in the embodiment of FIGS. 1-2), facilitating movement of slip 40 from its upper position to its lower position. As will be recognized by persons skilled in the art, as slip 40 moves downward, the volume of chamber 47 increases.

Figure 3:
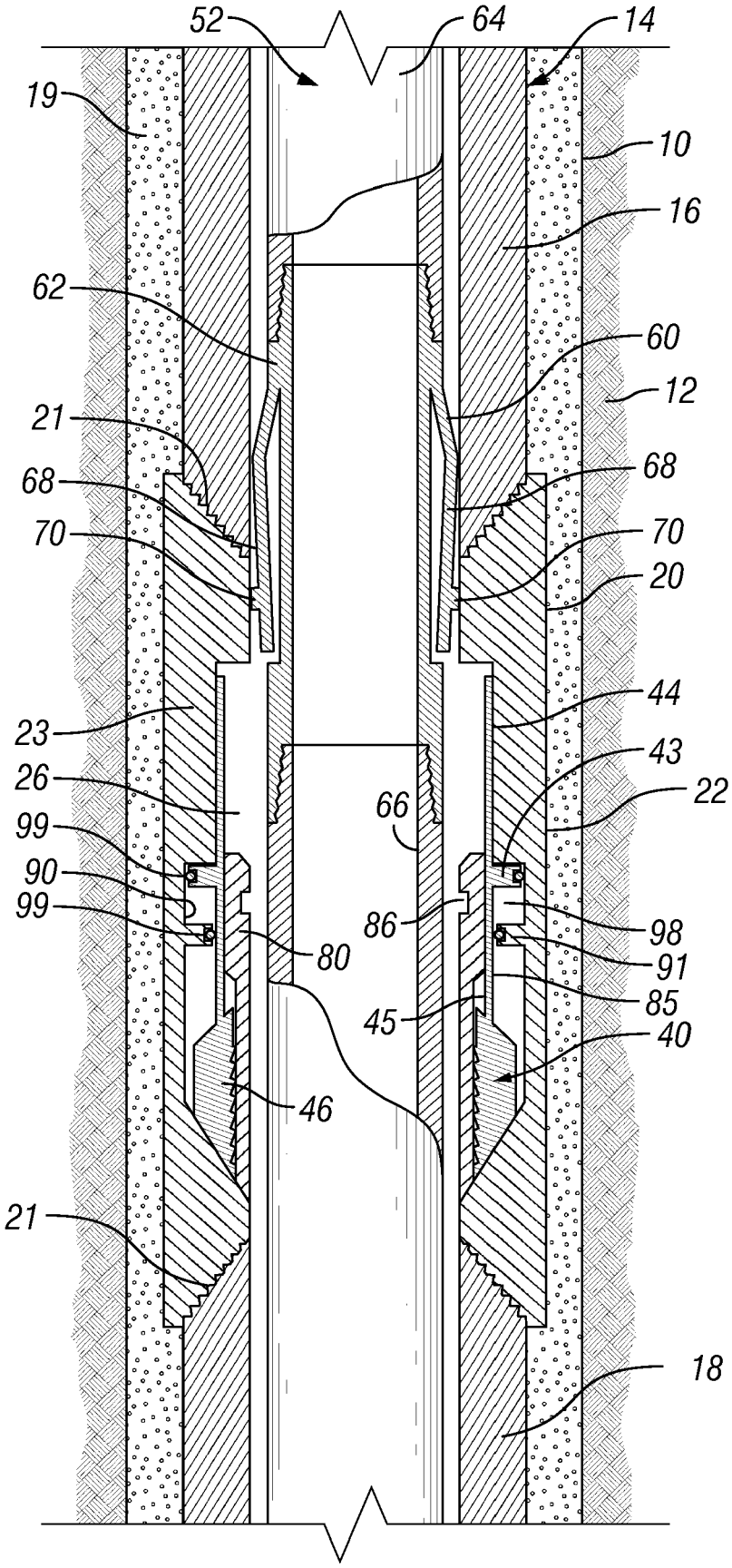
FIG. 3 is a partial cross sectional view of wellbore casing showing another specific embodiment of the coupler of the present invention during run-in of a liner.
Figure 4:
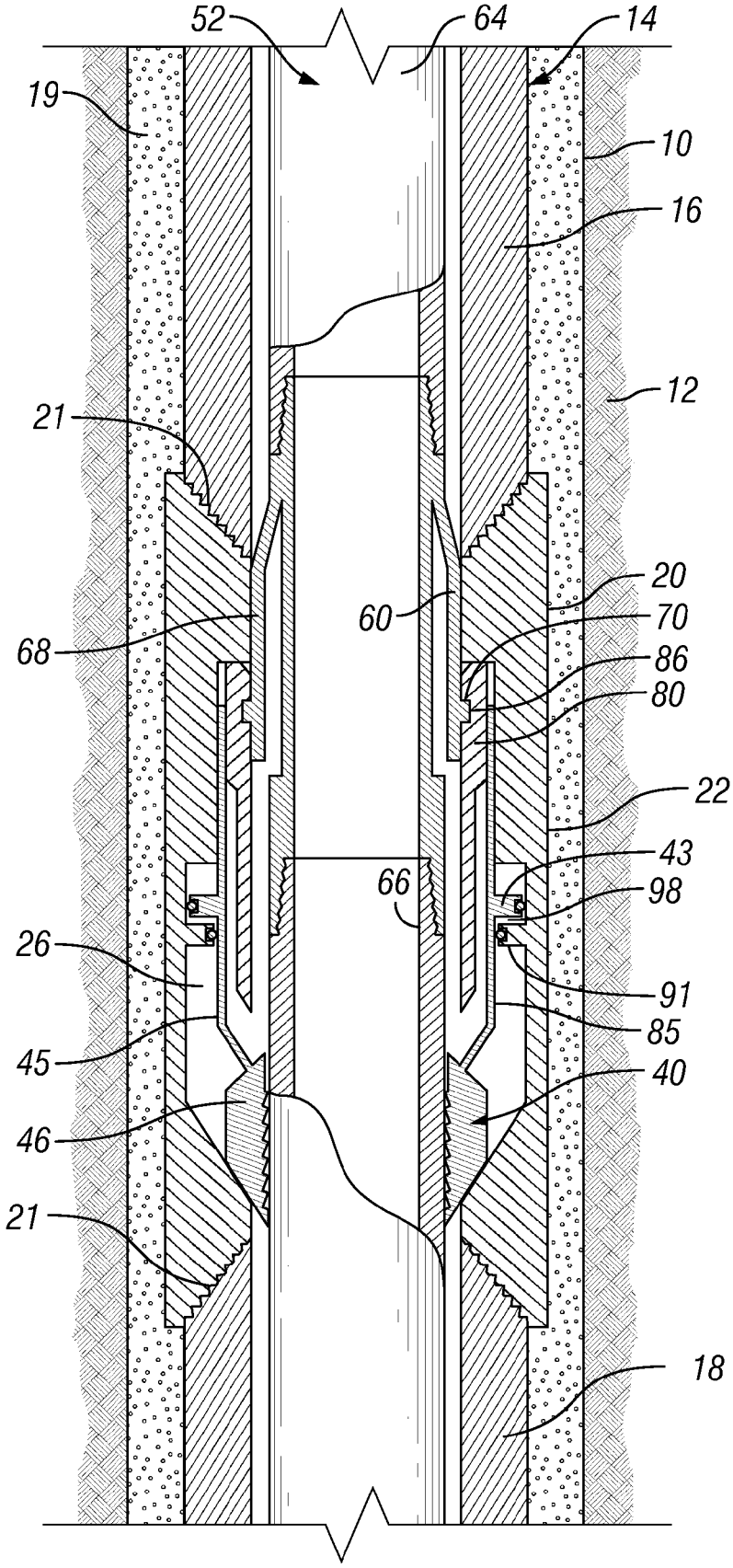
FIG. 4 is a partial cross-sectional view of the wellbore casing of FIG. 3 showing the coupler of FIG. 3 and the liner in the set position.

Referring now to FIGS. 3-4, in another embodiment, pocket 26 includes recess 90 formed by pocket flange 91. Slip 40 includes slip flange 43 disposed along outer wall surface 85 of slip 40 and is disposed within recess 90. Pocket flange 91 is in sliding engagement with an outer wall surface of slip 40 and slip flange 43 is in sliding engagement with an inner wall surface of recess 90. Chamber 98 is formed by pocket flange 91, slip flange 43, the inner wall surface of recess 90 and the outer wall surface of slip 40. Seals 99 (shown as elastomeric seals in FIGS. 3-4) facilitate isolation of chamber 98 which is maintained at atmospheric pressure. In operation, when cover 80 is moved from its first position to its second position (such as through the arrangement and methodology of the embodiments reflected in FIGS. 1-2), the pressure differential across slip flange 43 due to hydrostatic pressure being greater than the atmospheric pressure within chamber 98 causes slip 40 to move from the unset or upper position (FIG. 3) to the set or lower position (FIG. 4).

Figure 5:
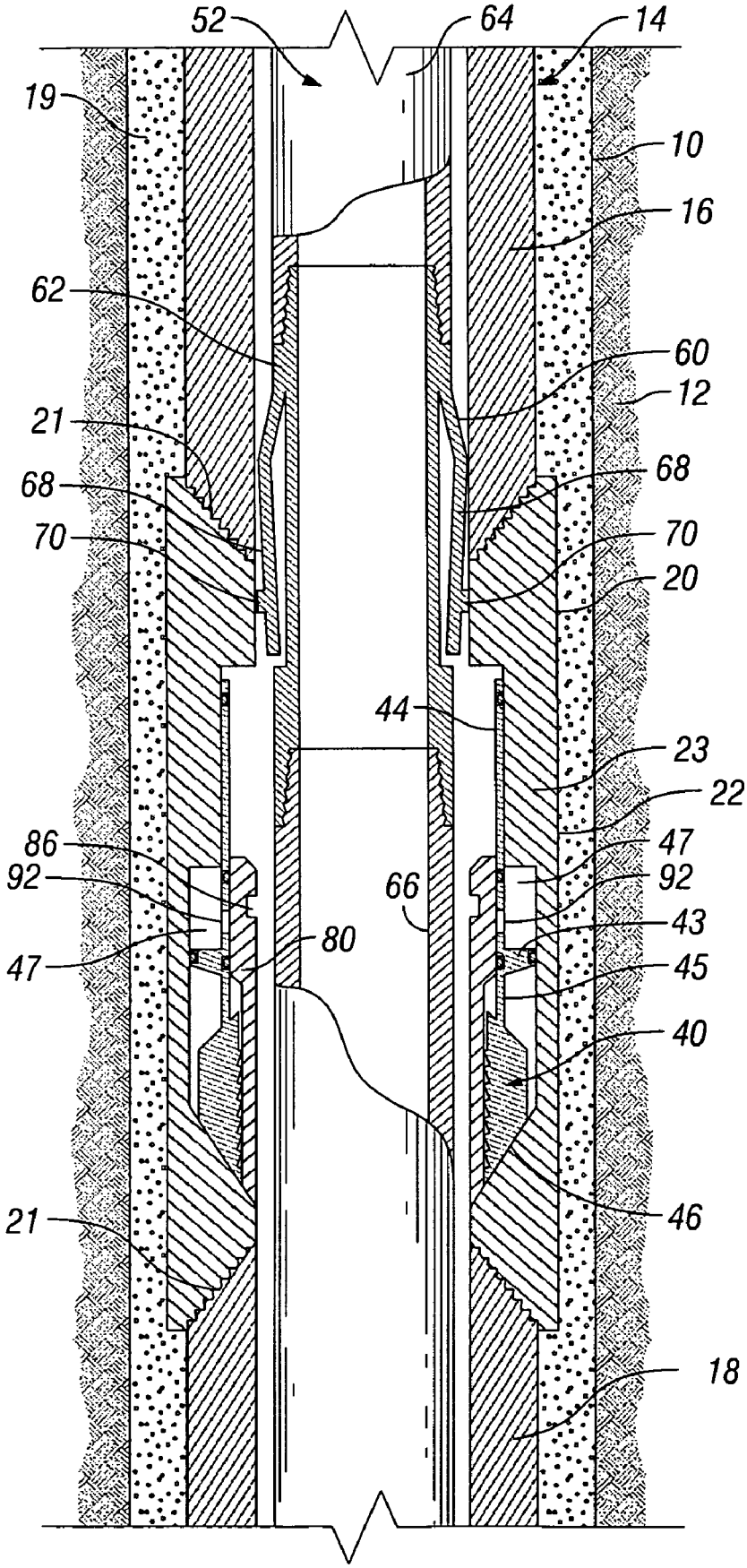
FIG. 5 is a partial cross sectional view of wellbore casing showing an additional specific embodiment of the coupler of the present invention during run-in of a liner.
Figure 6:
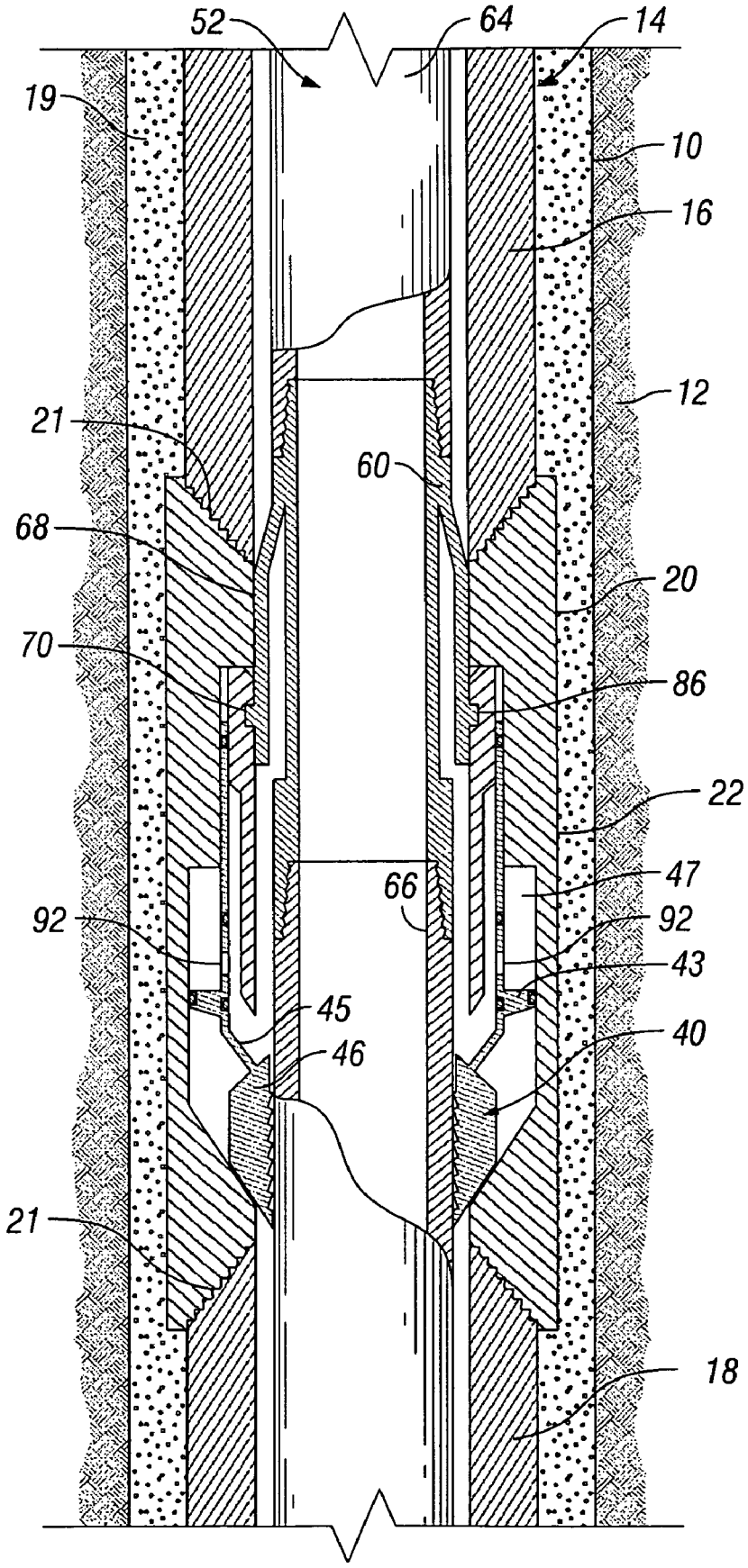
FIG. 6 is a partial cross-sectional view of the wellbore casing of FIG. 5 showing the coupler of FIG. 5 and the liner in the set position.

In another embodiment illustrated in FIGS. 5-6, coupler 20 is similar to the embodiment of FIGS. 1-2. In the embodiment of FIGS. 5-6, however, chamber 47 does not include a downwardly biased member. Instead, chamber 47 is at atmospheric pressure and includes seals (shown as elastomeric seals, but not numbered). Slip 40 comprises passage 92 in fluid communication with chamber 47. Passage 92 is isolated by seals (again shown as elastomeric seals, but not numbered) initially blocked by cover 80 when cover 80 is in its first position (FIG. 5). As cover 80 is moved to its second position (FIG. 6), such as by engaging tabs 70 with recess 86 as discussed in greater detail above with respect to FIGS. 1-2, passage 92 is placed in fluid communication with the housing bore. As a result, hydrostatic fluid and pressure is permitted to flow from the housing bore, through passage 92, and into chamber 47 so as to apply a downward force on the upper surface of slip flange 43. And, therefore, the hydrostatic pressure facilitates movement of slip 40 from its upper position (FIG. 5) to its lower position (FIG. 6) after cover 80 has been moved from its first position (FIG. 5) to its second position (FIG. 6).

Figure 7:
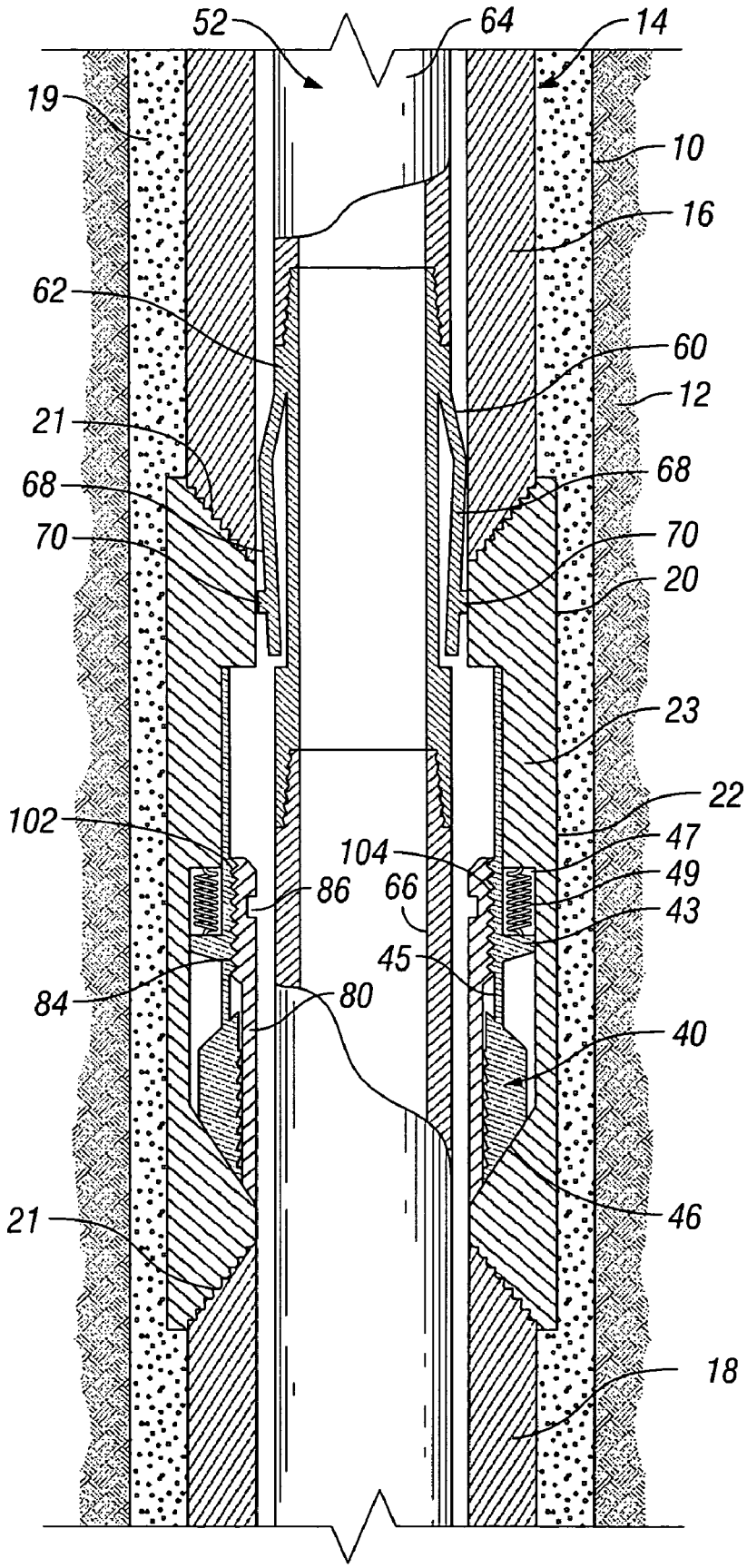
FIG. 7 is a partial cross sectional view of wellbore casing showing a further specific embodiment of the coupler of the present invention during run-in of a liner.
Figure 8:
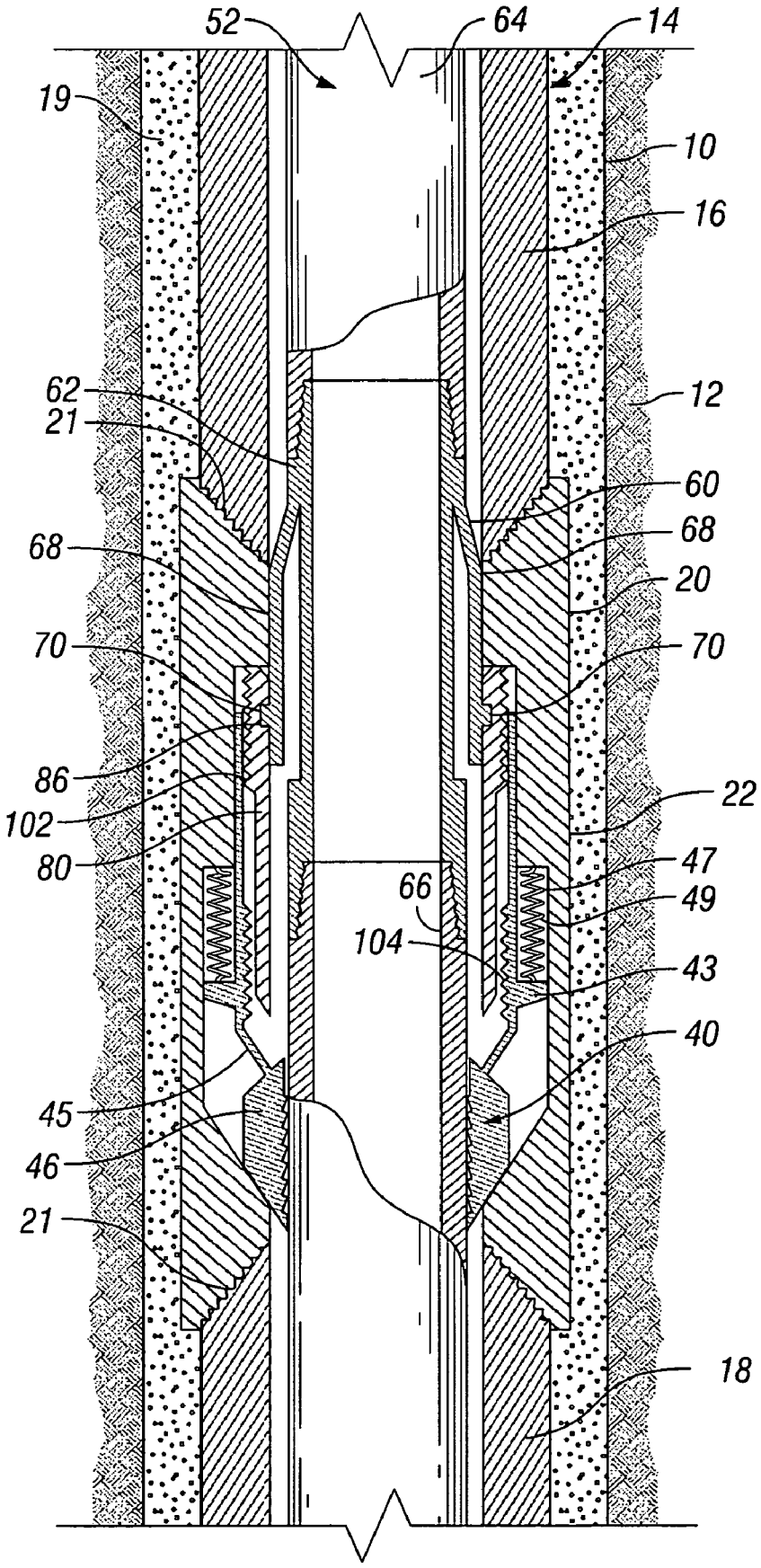
FIG. 8 is a partial cross-sectional view of the wellbore casing of FIG. 7 showing the coupler of FIG. 7 and the liner in the set position.

Referring now to FIGS. 7-8, in another embodiment, outer wall surface 84 of cover 80 comprises external helical threads 102. Internal helical threads 104 are disposed on the inner wall surface of slip 40 for receiving external helical threads 102. Thus, external and internal threads 102, 104 are interengaged with one another in a well-known manner such that rotation of cover 80 within casing coupler 20 will move cover 80 axially within coupler 20. Recess 86 is located on the radial inner wall surface 83 of cover 80 for facilitating rotation of cover 80 by engagement of tabs 70 with recess 86 as discussed in greater detail below.

As shown in FIG. 7, cover 80 is in its first position and slip 40 is in an unset, upper position. In FIG. 8, liner 52 has been inserted into casing string 14. Sub 62 having collet 60 is disposed between sections 64, 66 of liner 52 in the same manner as discussed in greater detail above with respect to FIGS. 1-2. In an alternative embodiment, collet 60 is connected directly to the outer wall surface of liner 52 such as by welding. Collect 60 includes one or more radially extending keys 70 that are shaped and sized to fit within their corresponding recess 86 in the same manner as the embodiment described above with respect to FIGS. 1-2. Like the embodiments in FIGS. 1-2, keys 70 are preferably spring-biased radially outwardly from the body of collet 60 so that they may be compressed radially inwardly as needed for disposal down through casing string 14 and to extend radially outward upon encountering recess 86. When keys 70 are located within recess 86, cover 80 is secured rotationally with respect to collect 60 and, thus, sub 62 and liner 52. As a result, rotating liner 52 from the surface of the well causes sub 62 and, thus, collet 60 and cover 80, to rotate. In order to set gripping member 46 into liner 52, liner 52 is rotated at the surface to cause cover 80 to move axially upward with respect to casing coupler 20, thereby moving cover 80 from its first, slip restricting position, to its second position in which slip 40 is capable of moving inwardly to its set position. As a result, gripping member 46 is moved downward and inward causing gripping member 46 to engage, bite, or cam into the outer radial surface of liner 52.

In one particular embodiment, the length of external helical threads 102 and internal helical threads 104 are such that slip 40 is released from the mated connection of external and internal helical threads 102, 104 after cover 80 has been moved to its second position (FIG. 8) so that slip 40 is capable of movement to its lower position (FIG. 8) immediately upon external and internal helical threads 102, 104 becoming unmated.

As with the embodiment shown in FIGS. 1-2, connection member 45 may flex during setting of slip 40 as shown in FIG. 2 or connection member 45 may collapse during setting of slip 40.

Figure 9:
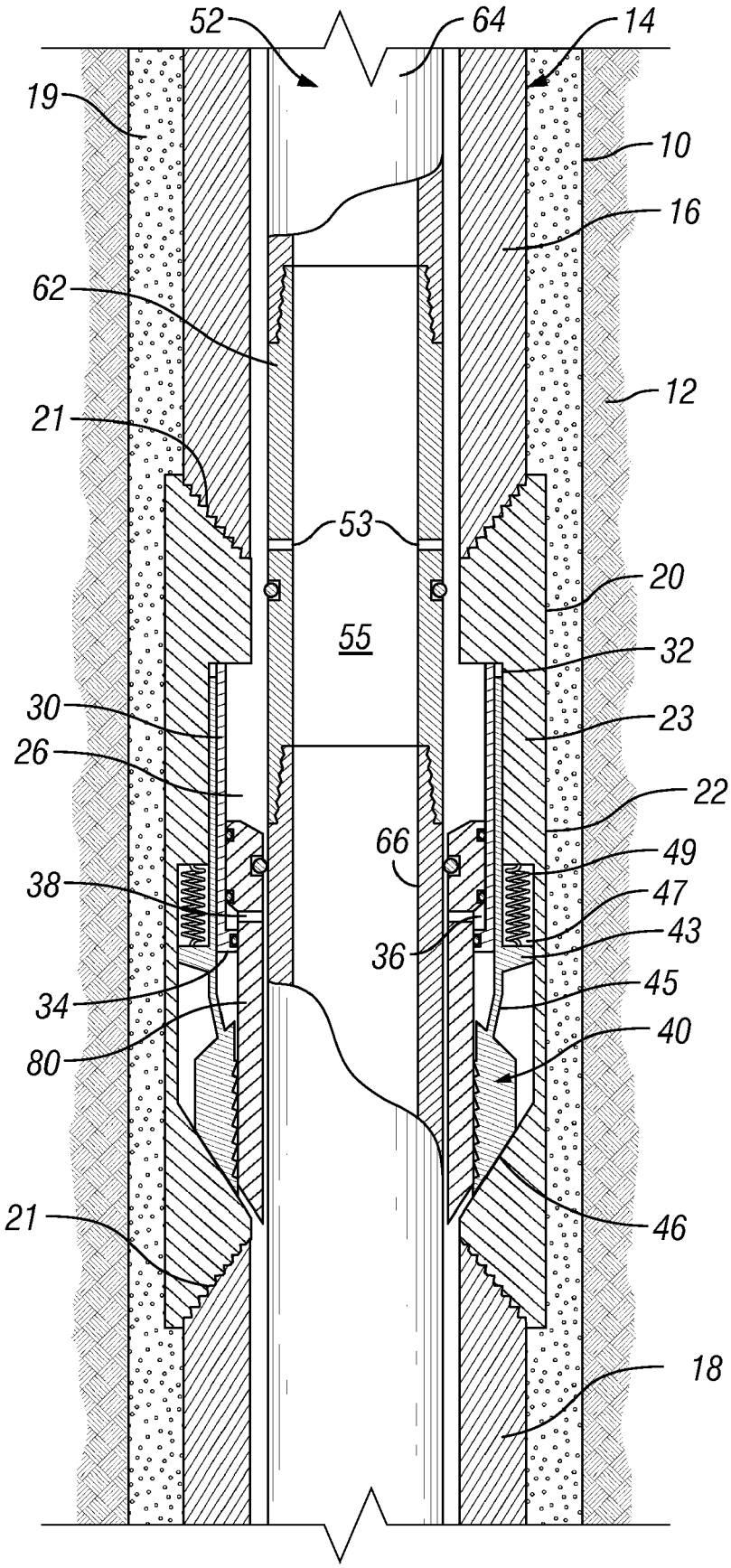
FIG. 9 is a partial cross sectional view of wellbore casing showing another specific embodiment of the coupler of the present invention during run-in of a liner.
Figure 10:
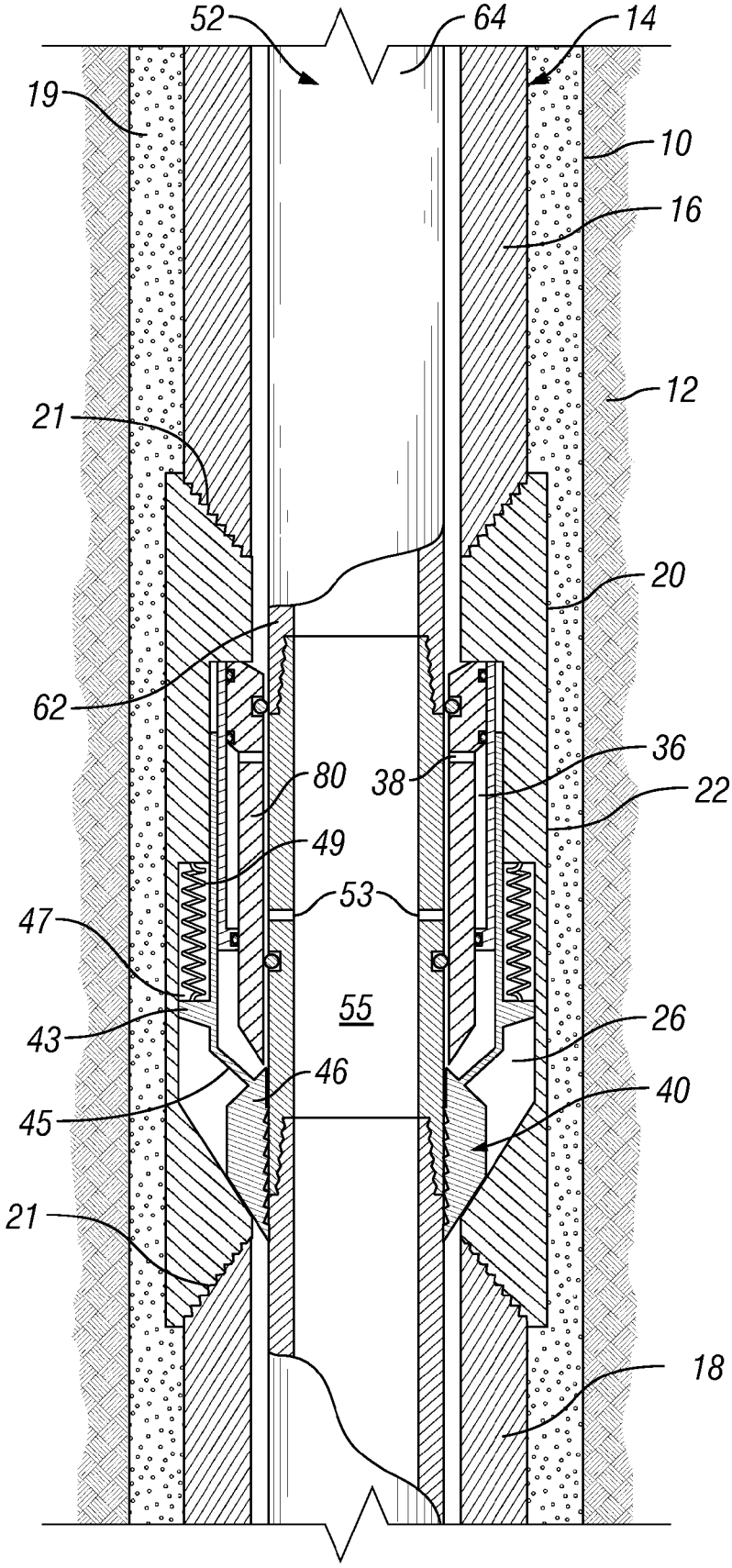
FIG. 10 is a partial cross-sectional view of the wellbore casing of FIG. 9 showing the coupler of FIG. 9 and the liner in the set position.

As illustrated in FIGS. 9-10, in another specific embodiment, cover 80 utilizes hydraulic fluid to move from its first position (FIG. 9) to its second position (FIG. 10). In this embodiment, pocket 26 includes sleeve 30 disposed therein. Sleeve 30 may be disposed within pocket 26 through any method or device known in the art. For example, sleeve 30 may be formed integral with housing 23. Alternatively, sleeve 30 may be welded in place or secured through threads disposed within housing 23.

The outer wall surface of sleeve 30 forms a groove 32 with housing 23 into which slip 40 is disposed. Sleeve 30 includes a sleeve flange 34 at its lower end. Cover 80 is in sliding engagement with the inner wall surface of sleeve 30. Cover 80 has a large upper end or head so that chamber 36 is defined by cover 80 and sleeve 30. Cover 80 also comprises port 38 in fluid communication with chamber 36 and the housing bore. Seals, shown as elastomeric seals, but not numbered are disposed along cover 80, sleeve flange 34, and liner 52 to isolate chamber 36.

As shown in FIGS. 9-10, slip 40 has the same structures, and downwardly biased member, as shown in FIG. 1-2. It is to be understood, however, that slip 40 of FIGS. 3-4, or any other design of slip 40 may be used in connection with the embodiment of FIGS. 9-10.

The lower end of liner 52 is closed off by a plug (not shown). The plug is preferably a temporary or removable plug which can be removed, such as by milling, to allow flow through liner 52 at a later point during production operations. Ports 53 are disposed through the side of liner 52. Various seals (shown as elastomeric seals, but not numbered) are provided to isolate fluid communication between ports 53 and ports 38 when ports 53 are properly disposed within the housing bore.

In operation, cover 80 is initially in its first position (FIG. 9) and slip 40 is initially in its upper position (FIG. 9). Liner 52 is then disposed into casing string 14 until ports 53 of liner 52 are generally aligned with fluid flow ports 38 in cover 80 (FIG. 10). The interior flowbore 55 of liner 52 is then pressurized so that fluid is flowed through the aligned ports 53 and 38 and into fluid chamber 36. Cover 80 is urged upward by the fluid pressure so that cover 80 moves toward its second position (FIG. 10). Upon reaching its second position (FIG. 10), cover 80 is no longer restricting the ability of slip 40 to move from its upper position (FIG. 9) to its set or lower position (FIG. 10). As a result, gripping member 46 moves inwardly so that gripping profile 48 engages, bites, or cams, into the outer wall surface of liner 52 (FIG. 10). As with the previously discussed embodiments shown in FIGS. 1-8, connection member 45 may flex during setting of slip 40 as shown in FIG. 2 or connection member 45 may collapse during setting of slip 40.

Once secured within coupler 20 by slip 40 moving to its lower position (FIG. 10), liner the plug can be drilled or milled away so that liner 52 can be use in production or other desired operations.

Figure 11:
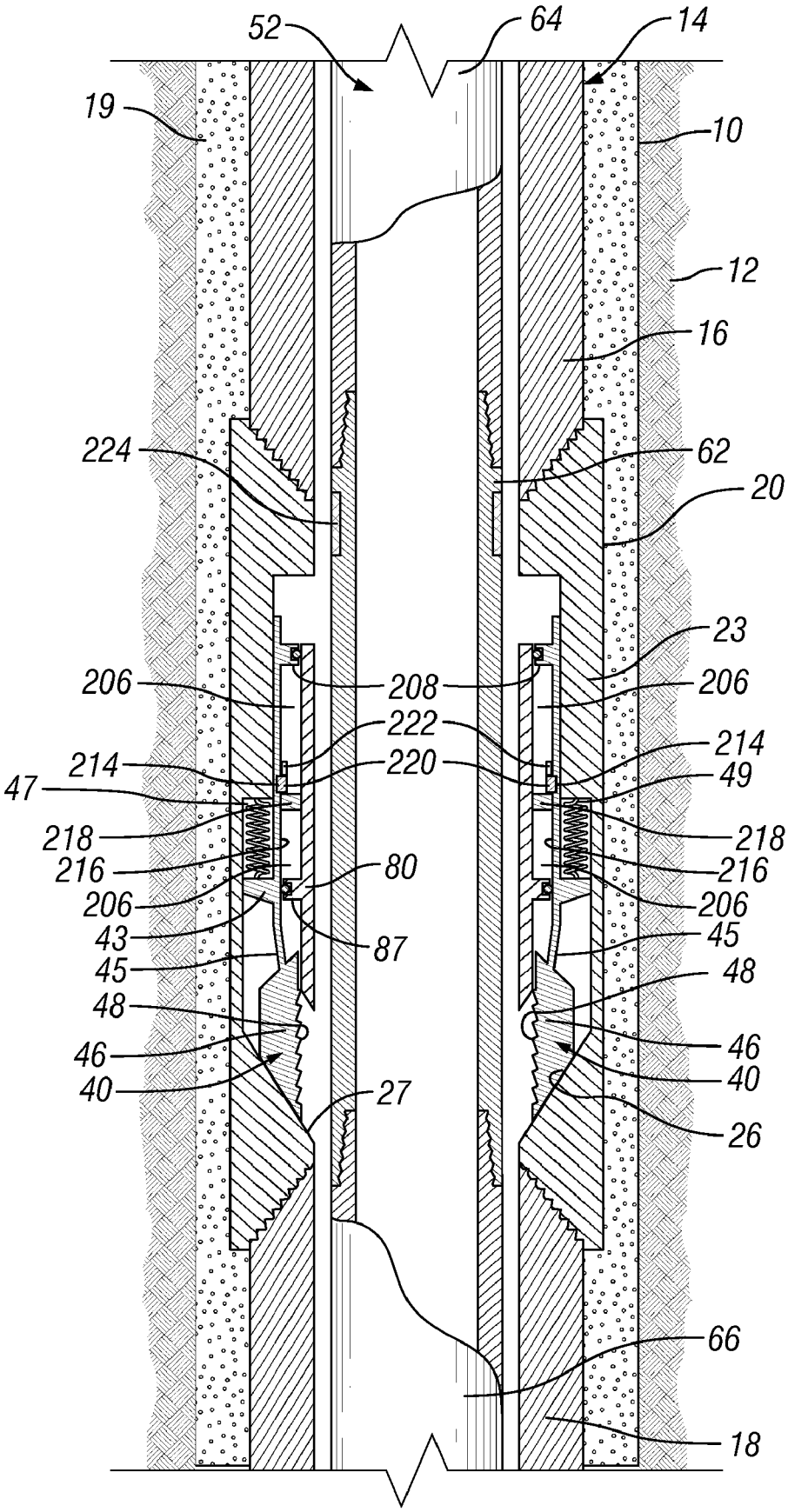
FIG. 11 is a partial cross sectional view of wellbore casing showing an additional specific embodiment of the coupler of the present invention during run-in of a liner.
Figure 12:
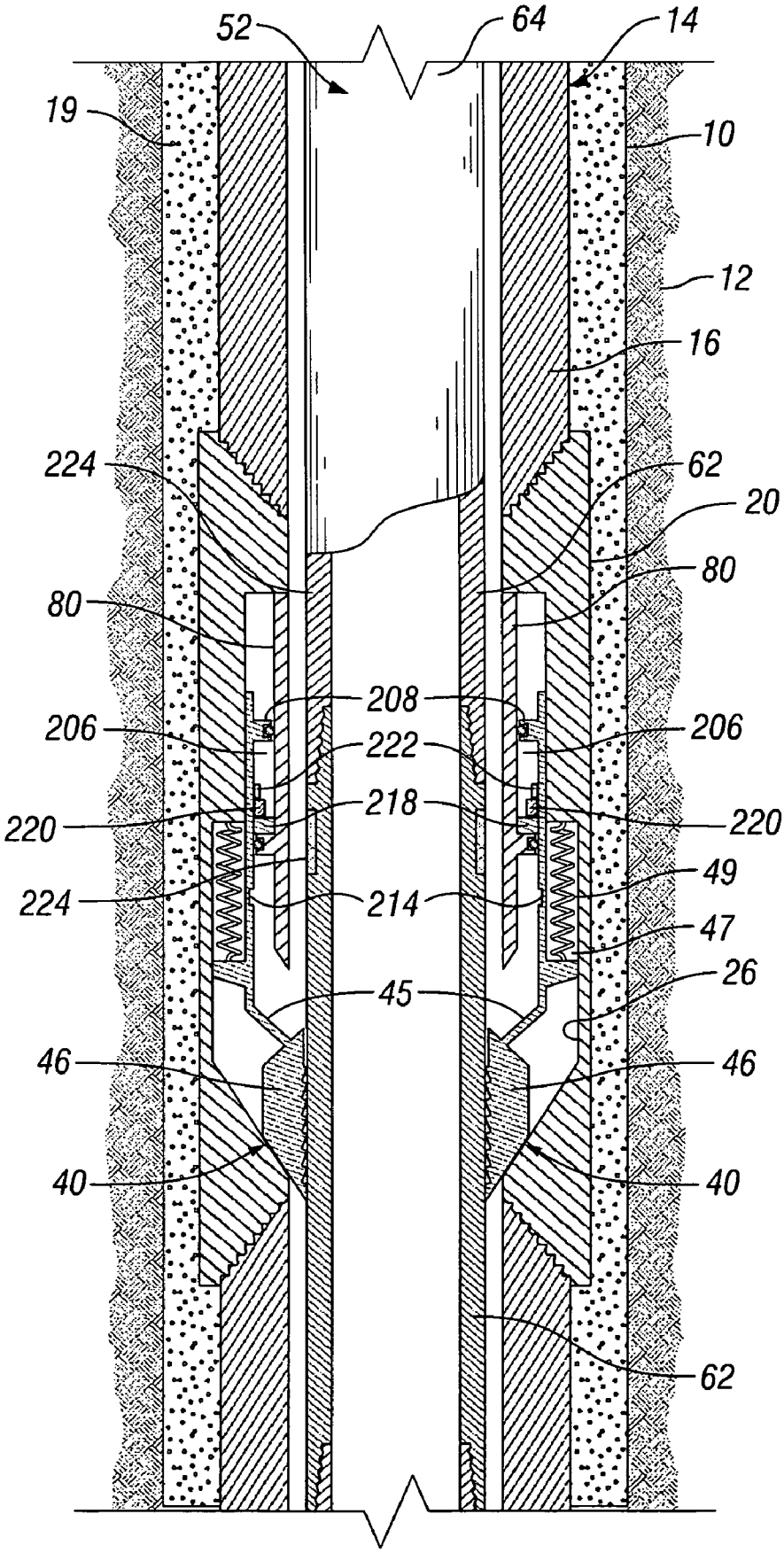
FIG. 12 is a partial cross-sectional view of the wellbore casing of FIG. 11 showing the coupler of FIG. 11 and the liner in the set position.

Referring now to FIGS. 11-12, in another specific embodiment, slip 40 includes slip flange 208 disposed along an inner wall surface of slip 40. Slip flange 208 is in sliding engagement with the outer wall surface cover 80 and, as shown, includes an elastomeric seal.

Cover 80 comprises cover flange 87 disposed along outer wall surface 84 of cover 80. Cover flange 87 is in sliding engagement with the inner wall surface of slip 40 and, as shown, includes an elastomeric seal. As shown, cover 80 does not touch shoulder 27 in the first position (FIG. 11). Therefore, the area below cover flange 87 under wellbore or hydrostatic pressure at all times.

The lower surface of slip flange 208 upper surface of cover flange 87, the inner wall surface of slip 40, and the outer wall surface of cover 80 define chamber 206. Recess 214 is inscribed in the inner wall surface of slip 40 within chamber 206. Also within chamber 206, stop ring 218 is fixedly secured to inner wall surface 216 of slip 40 and is, in turn, secured to a split ring, or C-ring member 220. Although stop ring 218 is shown in FIGS. 11-12 as being in contact with cover 80, it is to be understood that a gap may be between stop ring 218 and cover 80; provided that stop ring 218 continues to contact split ring 220.

In the first position (FIG. 11), split ring 220 resides within recess 214 of slip 40. Split ring actuator 222 is operably interconnected with split ring 220. Split ring actuator 222 may comprise a programmable electronic transceiver that is designed to receive a triggering signal from a transmitter. Signal transmitter 224 is incorporated within liner 52. In one embodiment, signal transmitter 224 may comprise a RFID (radio frequency identification) tag or chip that is designed to emit a triggering signal upon passing within a certain proximate distance of actuator 222. Actuator 222 is operably associated with split ring 220 to retract split ring 220 radially inwardly and out of recess 214 upon receipt of the signal from transmitter 224. Radial retraction of split ring 220 may be done by the actuator mechanically, magnetically, or using other suitable known techniques.

Chamber 206 is at a lower pressure, e.g., atmospheric pressure, as compared to the hydrostatic pressure disposed directly below cover flange 87 so that there is a pressure differential across cover flange 87. The pressure differential urges cover flange 87 and, thus, cover 80, upward toward the second position (FIG. 12).

In operation, cover 80 is initially in the first position and slip 40 is initially in the upper or unset position shown in FIG. 11. Liner 52 is lowered into casing string 14 until transmitter 224 is located proximate actuator 222. The triggering signal is received by actuator 222, which then releases split ring 220 from recess 214. If desired, a delay could be incorporated into the programming of actuator 222 such that a predetermined period of time elapses between the time the triggering signal is received by actuator 222 and split ring 220 is released from recess 214. When split ring 220 is released from recess 214, the hydrostatic pressure disposed below cover flange 87 urges cover 80 axially upward so that slip 40 is capable of movement from its upper position (FIG. 11) to its lower position (FIG. 12) in which gripping member 46 moves downward and, thus radially inward, so that gripping profile 48 engages, bites, or cams into liner 52 as shown in FIG. 12, thereby securing liner 52 within casing string 14. As with the previously discussed embodiments shown in FIGS. 1-10, connection member 45 may flex during setting of slip 40 as shown in FIG. 2 or connection member 45 may collapse during setting of slip 40.

As also with other embodiments discussed herein, slip 40 may include slip flange 43 disposed on the outer wall surface of slip 40 to form chamber 47 having coiled spring 49 as shown in FIGS. 11-12 to facilitate movement of slip 40 to the lower position. Alternatively, slip 40 may be modified to include one or more alternative designs, such as those disclosed herein, to facilitate movement of slip 40 from its upper position to its lower position after cover 80 has been moved from its first position to its second position.

It is to be understood that the invention is not limited to the exact details of construction, operation, exact materials, or embodiments shown and described, as modifications and equivalents will be apparent to one skilled in the art. For example, a ratchet mechanism may be located within the pocket 26 and operatively associated with the slip, such as thorough the slip flange, to operate in the manner of a body lock ring to ensure one-way sequential movement of the slip with respect to the surrounding casing coupler 20. Such a ratchet mechanism may also be utilized with any of the other embodiments so that liner 52 cannot be removed from the slip by upward movement alone. Additionally, the coupler may have only one slip or a plurality of slips having a space between each slip. Moreover, the recess within cover may be a single continuous groove along the outer wall surface of the cover or it may be one or more short slots. Further, the slip may be a single sleeve component having one or more gripping members. Additionally, in the embodiment in which liner 52 includes one or more port 53, and seals may be disposed on cover 80 instead of on liner 52. Further, transmitter 224 may not be located on the liner, but instead transmitter 224 may be located elsewhere, such as on the casing string, in the coupler, or as part of the setting mechanism. In such an embodiment, transmitter 224 is activated from the surface of the wellbore after the liner is placed in its desired position within the casing. Additionally, the elastomeric seals shown, but not numbered, in several of the embodiments may be dynamic metal-to-metal seals or any other type of seal known in the art. And, the seals may be disposed at locations other than those illustrated in the Figures. In addition, the cover 80 can also comprises port that provides fluid communication between the wellbore of casing string 14 and the area disposed below cover flange 87 in the embodiment of FIGS. 11-12 such that cover 80 initially completely blocks slip 40 such as shown in FIG. 1. The port permits fluid to flow directly below the cover flange 87 before cover 80 begins to move upward. Accordingly, the invention is therefore to be limited only by the scope of the appended claims.

What is claimed is:

1. A liner hanger for hanging a liner within a bore of a casing string, the liner hanger comprising:

a housing for securing into the casing string at a desired location, the housing having a housing bore, an outer wall surface, and an inner wall surface, the inner wall surface having a pocket disposed thereon;

a slip disposed within the pocket, the slip having a gripping inner wall surface, the slip being movable from an upper position fully recessed within the pocket to a lower position wherein the gripping inner surface protrudes inward from the pocket;

a cover disposed interior to the slip, the cover having a first position in which the cover restricts movement of the slip toward the lower position, and a second position in which the slip is capable of movement toward the lower position; and an actuator for connection to a liner for placement within the housing bore, the actuator when in the housing bore, causing the cover to move from the first position to the second position so that the slip is capable of moving from the upper position to the lower position to engage and secure the liner within the bore, wherein the slip comprises a flange member in sliding engagement with an inner wall surface of the pocket to form a chamber, the chamber comprising a downwardly biased member operatively associated with the flange member of the slip for facilitating movement of the slip from the upper position to the lower position.

2. The liner hanger of claim 1, wherein the cover includes at least one recess disposed on an interior wall surface and the actuator comprises at least one key that enters the recess so that upward movement of the liner moves the cover from the first position to the second position.

3. The liner hanger of claim 2, wherein the actuator biases the key outward.

4. The liner hanger of claim 2, wherein the cover comprises a threads disposed on an outer wall surface for matingly engaging threads disposed on an inner wall surface of the slip so that upward movement of the cover is achieved by rotating the liner.

5. The liner hanger of claim 1, wherein the downwardly biased member comprises a spring.

6. The liner hanger of claim 1, wherein the pocket comprises a sleeve disposed within the pocket, the sleeve forming a groove for receiving the slip, the cover is in sliding engagement with the sleeve, an outer wall surface of the cover and an inner wall surface and a flange of the sleeve form a chamber, the cover comprises a port leading from the housing bore to the chamber.

7. The liner hanger of claim 6, wherein the actuator comprises a port disposed through a side wall of the actuator, the port being alignable to the passage when the actuator is within the housing bore such that a fluid pressure transmitted through the liner and port applies the fluid pressure to the cover to move the cover upward from the first position to the second position.

8. The liner hanger of claim 1, wherein the slip comprises a slip flange disposed on an inner wall surface of the slip, the slip flange in sliding engagement with an outer wall surface of the cover;

the cover comprises a cover flange on the outer wall surface of the cover, the cover flange in sliding engagement with the inner wall surface of the slip, the inner wall surface of the slip, the outer wall surface of the cover, the slip flange and the cover flange forming a chamber, the chamber comprising a piston separating the chamber into an upper portion and a lower portion, the lower portion having a larger volume than a volume of the upper portion, the chamber further comprising a detent for releasably retaining the piston in an initial position, and the actuator comprising a device for releasing the detent so that the cover moves upward from the first position to the second position.

9. A method of securing a liner within a bore of a casing string disposed in a wellbore, the method comprising the steps of:

(a) disposing within a wellbore at least two sections of casing secured together by a casing coupler to form the casing string, the casing coupler comprising a housing having a pocket disposed on an inner wall surface of the housing, the pocket having a slip, the slip comprising an upper position and a lower position, the slip engaging an outer wall surface of a liner disposed within a casing string bore when the slip is in the lower position, and a cover, the cover having a first position in which the cover restricts movement of the slip toward the lower position, and a second position in which the slip is capable of movement toward the lower position wherein the slip comprises a flange member in sliding engagement with an inner wall surface of the pocket to form a chamber, the chamber comprising a downwardly biased member operatively associated with the flange member of the slip for facilitating movement of the slip from the upper position to the lower position;

(b) lowering the liner into the bore of the casing string, the liner having an actuator mounted thereon;

(c) positioning the actuator in the casing coupler;

(d) actuating the cover by the actuator; and (e) moving the cover from the first position to the second position so that the downwardly biased member moves the slip from the upper position to the lower position and, thus, the slip engages the outer wall surface of the liner to secure the liner within the casing string of the wellbore.

10. The method of claim 9, wherein step (d) is performed by matingly engaging at least one key disposed on the actuator within at least one recess disposed on the cover and moving the liner upward within the bore of the casing string to move the cover from the first position to the second position.

11. The method of claim 10, wherein in step (d), the liner is rotated while moving the liner upward within the bore of the casing string.

12. The method of claim 9, wherein step (d) is performed by moving upward the cover by pumping fluid down a liner bore of the liner, through a port in the actuator, and through a passage in the cover so that fluid moves the cover in an upward direction.

13. The method of claim 9, wherein step (d) is performed by transmitting a signal from a transmitter disposed on the actuator to a detent disposed on the cover, the detent releasing the cover to move upward upon receiving the signal from the transmitter, the cover being biased upward.

* * * * *